United States Patent [19]

Hadden

[11] Patent Number: 4,727,707

[45] Date of Patent: Mar. 1, 1988

[54] PACKAGING FILM FEEDING APPARATUS AND METHOD

[75] Inventor: William A. Hadden, Conyers, Ga.

[73] Assignee: Kliklok Corporation, Decatur, Ga.

[21] Appl. No.: 941,694

[22] Filed: Dec. 15, 1986

[51] Int. Cl.[4] ..... B65B 41/18; B65B 9/08

[52] U.S. Cl. ..... 53/451; 53/51; 53/66; 53/552

[58] Field of Search ..... 53/451, 51, 66, 551, 53/64, 552, 373

[56] References Cited

U.S. PATENT DOCUMENTS

| | | | |
|---|---|---|---|
| 3,546,835 | 12/1970 | Mobley | 53/551 X |
| 3,787,001 | 1/1974 | Henry . | |
| 3,889,446 | 6/1975 | Simmons et al. . | |
| 4,081,944 | 4/1978 | Sjostrand | 53/51 |
| 4,128,985 | 12/1978 | Simmons | 53/51 |
| 4,288,965 | 9/1981 | James | 53/51 X |
| 4,316,566 | 2/1982 | Arleth et al. | 53/51 X |
| 4,501,109 | 2/1985 | Monsees | 53/551 X |
| 4,532,753 | 8/1985 | Kovacs | 53/373 X |
| 4,546,596 | 10/1985 | Cherney | 53/551 X |
| 4,549,386 | 10/1985 | Wilson | 53/51 |
| 4,552,608 | 11/1985 | Hoffmann et al. | 53/51 X |

FOREIGN PATENT DOCUMENTS 0165818 12/1985 European Pat. Off. .

*Primary Examiner*—Horace M. Culver

*Attorney, Agent, or Firm*—King and Schickli

[57] ABSTRACT

A form, fill and seal packaging machine includes a tube former for forming a film having spaced apart registration marks thereon into a tube around a hollow mandrel. A pair of endless belt devices driven by stepping motors, located at the sides of the hollow mandrel advances the film through the machine. A stripping and sealing apparatus is located beneath the mandrel, for stripping product from the area of the film tube to be sealed, and sealing and cutting a filled package from the tube. A photoelectric cell located upstream of the tube former senses the passing of each registration mark as the film is fed. The photoelectric cell is operatively associated with the belt drive and the actuator for the stripper and the sealer through an index controller. The index controller deactivates the stepping motors. A master controller activates the stripper/sealer actuator at a predetermined point in each packaging cycle. A method of making form, fill and seal packages of constant length includes the steps of intermittent feeding by increments a full length of film having a registration mark at an intermediate point, sensing said registration mark during the time the film is being fed, counting predetermined feed increments past the registration mark during continued film feeding, and sealing the package at a location identified by reaching the predetermined number of feed increments.

9 Claims, 6 Drawing Figures

PACKAGING FILM FEEDING APPARATUS AND METHOD

FIELD OF THE INVENTION

The present invention relates to package forming, and more particularly to efficiently feeding a film for making form, fill and seal packages.

BACKGROUND OF THE INVENTION

Machines and methods for the forming, filling and sealing of packages made from a web or film or material are known in the art. These machines typically comprise a supply of package film, a former for forming the film into a continuous tube over a hollow, cylindrical mandrel, a device for feeding lengths of the film through the machine, and reciprocating stripping, sealing and cutting jaws for sealing and cutting the tube into a consecutive series of filled packages.

It is also known to use packaging film having preprinted marks on the film at each package length, and use a photocell control responsive to the preprinted marks to control the length of packaging film being fed.

In one known packaging machine, the film is fed from a driven roll of film through sealing and cut-off jaws. A photocell senses a preprinted mark on the package film being fed from the film roll to the sealing and cut-off jaws, and, working through a control device, thereupon brakes the drive and actuates the sealing and cut-off jaws. After a timed interval the film brake is released to resume the feeding of another length of package film until the photocell senses another preprinted mark on the film being fed and again brakes the film and actuates the sealing and cut-off jaws.

Another known packaging machine has a photocell and photoregistration control circuit which reads preprinted marks along the length of the package film. With the film being fed through the machine, when a preprinted mark is sensed by the photocell, the photoregistration control circuit signals a timer. Upon timing out, the timer actuates a brake of the film feeder device and actuates a second timer controlling the operation of a package sealer and cut-off device. After the second timer has timed out, the brake of the film feeder device is released and the package film is again fed until the next mark is sensed and the above sequence is repeated.

Yet another known packaging machine uses a clutch/brake unit operated by a programmable controller, and connected to an operating motor to drive a roll of package film to feed a length of package film through a package film sealing member. The packaging film has registration marks at package length intervals. The clutch remains activated providing for driving the roll of package film and feeding a length of package film until an optical scanner detects the passing of a registration mark on the package film and sends a signal to the programmable controller which disengages the clutch and engages the brake to stop the feeding of the package film. After a timed period sufficient to provide for the filling, sealing and cut-off of a package, the clutch is re-engaged and the brake disengaged thereby feeding another length of package film.

However, in these prior known machines difficulties arise in maintaining the lengths of package film being fed at exact dimentions, particularly as the package film may shrink or be stretched as it is being fed through these machines. Also because of high acceleration/deceleration forces, the belt wear that is experienced is unusually high. Also, these unusualy high forces actually limit the film types and the gauges of film that can successfully be used.

OBJECTS OF THE INVENTION

Accordingly, it is an object of the present invention to provide a form, fill and seal packaging machine, and a method making a form, fill and seal package which is more efficient, and especially effective to provide control for film shrinkage and stretching.

It is another object of the invention to intermittently feed a film length corresponding to the exact length of a package to be formed.

It is yet another object of the invention to provide a packaging machine and packaging method employing packaging film having a registration mark intermediate the film feed lengths.

It is still another object of the invention to provide a packaging machine and packaging method which identifies the sealing location on the package film by counting a predetermined number of feed increments past a registration mark during the continued feeding of the packaging film, and provides compensation of the length, when necessary.

It is still another object of the invention to provide a packaging machine and packaging method with carefully controlled acceleration/deceleration allowing intermittent feed of package lengths with minimum belt wear and allowing the use of a wide range of film types/gauges.

BRIEF DESCRIPTION OF THE INVENTION

The present invention provides a form, fill and seal packaging machine which comprises a former at the top end of a hollow tube forming mandrel for wrapping packaging film around the mandrel and forming a film tube. The packaging film is supplied to the former from a supply roll of film. Two spaced apart endless belt film feed devices driven by stepping motors are located on opposite sides of the mandrel engaging the film tube wrapped around the mandrel for intermitently feeding the film in controlled package lengths through the packaging machine.

Product to be packaged is introduced into the open top end of the mandrel and falls therethrough into the package film tube depending from the bottom end of the mandrel. A stripping and sealing apparatus is positioned beneath the bottom end of the mandrel for stripping any product from the area of the film tube to be sealed, sealing the tube and cutting a resulting package from the film tube. By driving the film feed belts in increments or pulses by drive means, for example, the stepping motors, the necessary control to provide a full length of film corresponding to the desired length of a package each time is obtained. The feed belts are operated on an intermittent motion basis; each operation cycle of the belts defining a bag length.

The film has registration marks at an intermediate point of each full length of film being incrementally fed. An optical sensor is located between the film supply roll and film former to detect the registration marks. The optical sensor is operatively connected to an index controller, and the index controller is operatively interconnected to the incremental drive of the film feed device, and the actuator of the stripping and sealing apparatus. The index controller counts a predetermined number increments of the film feed and terminates the film feed at the proper moment during each package cycle. A master controller synchronized with the index controller activates stripping and sealing apparatus to strip and seal the film tube at the proper location identified by the predetermined number of feed increments counted by the index conroller.

The method of the present invention for making a form, fill and seal package comprises the steps of feeding a full length of film by increments, the film having a registration mark at an intermediate point of the full length, sensing the registration mark on the film during continued feeding of the film, counting a predetermined number of feed increments after the registration mark has been sensed, and sealing the package at the location corresponding to reaching that predetermined number of feed increments.

The index controller is programmed to provide constant acceleration followed by constant deceleration to maximize the use of the driving time, and minimizing slippage and belt wear. If shrinkage or stretching occurs during the packaging operation, the index controller reduces or increases the overall average velocity of the stepping motors; that is, by increasing or decreasing the acceleration the machine proportionally lenghtens or shortens the package length. The index controller monitors the feed at all times. The counting of motor pulses between the index marks makes certain that the size of the bag, and the stripping/sealing procedures are efficiently and accurately carried out. The index controller is preset for each size package and controls the length by properly setting the acceleration and declaration of the stepping motors.

Still other objects and advantages of the present invention will become readily apparent to those skilled in the art from the following detailed description wherein I have shown and described only the preferred embodiment of the invention, simply by way of illustration of the best mode contemplated by me for carrying out my invention. As will be realized, the invention is capable of other and different embodiments, and its several details are capable of modification in various obvious respects, all without departing from the invention. Accordingly, the drawings and description are to be regarded as illustrative in nature, and not as restrictive.

DETAILED DESCRIPTION OF THE PREFERRED EMBODIMENT

Figure 1:
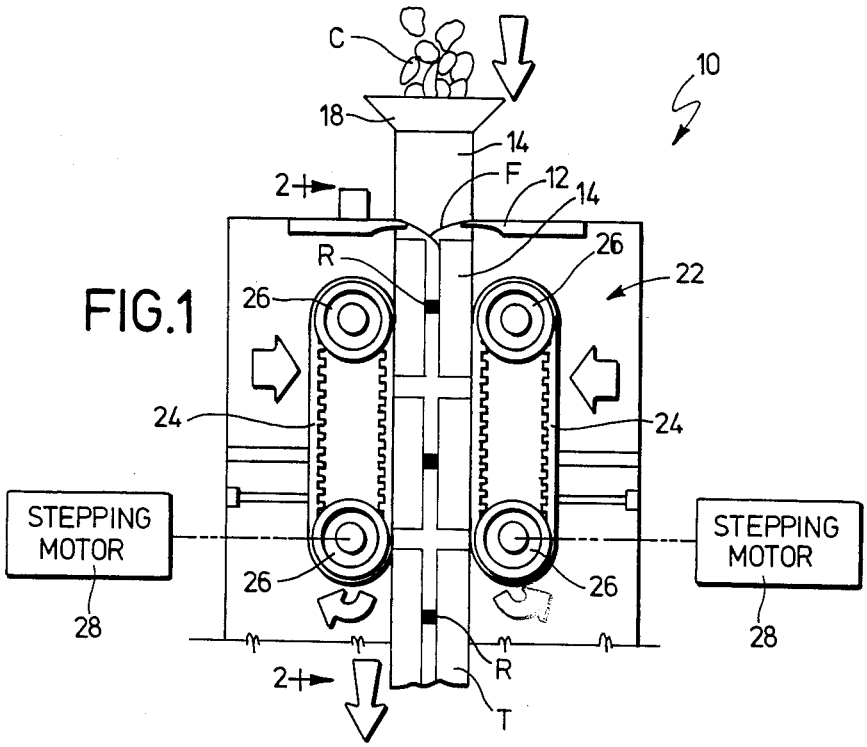
FIG. 1 is a schematic side view of a portion of a form, fill and seal package machine embodying features of the present invention.
Figure 5:
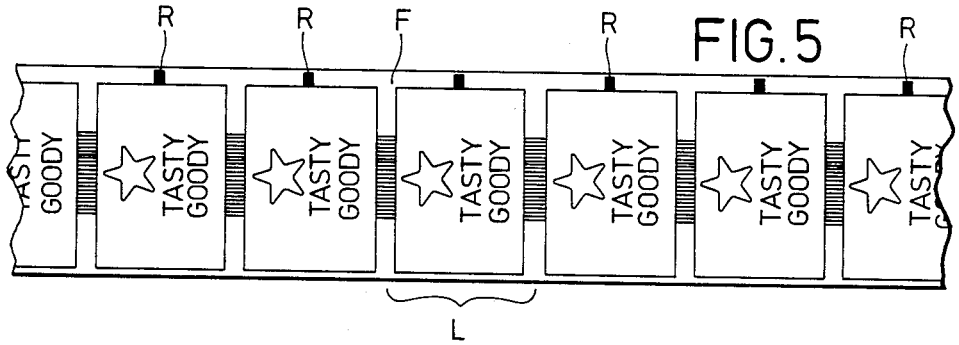
FIG. 5 is a plan view of a strip of package film showing the position of preprinted registration marks in relationship to the desired sealing locations; and, FIG. 6 is a graph illustrating the concurrent movement of the carriage and jaws of the stripping and sealing apparatus, and the film feed belts of the machine of FIGS. 2 through 4.

With reference to FIGS. 1 through 4, there is shown in schematic form a packaging apparatus, generally denoted as the numeral 10, of the form, fill, and seal type. Packaging film F is fed from a supply roll 11 and is moved over a tube former 12 to form a continuous tube T thereof. The longitudinal margins or edges of the film F come together in overlapping relationship in the area of the tube former 12 and around a hollow mandrel 14. A heated shoe (not shown) located adjacent the mandrel 14 operates in a manner well known in the art to seal the overlapping longitudinal margins or edges of the film and, thereby seal the tube T around the periphery of the mandrel 14.

The packaging apparatus 10 also includes a feed chute 16 for delivering bulk material or product C, such as potato chips, into a funnel shaped top 18 of the mandrel 14. A measured quantity of product C is released and travels by gravity down the chute 16 and mandrel 14 into the tube T of the packaging film. The product C falls by gravity into the bottom of the tube extending from the bottom open end of the mandrel 14 where a package P is being formed just above a transverse seal 20 formed at the bottom of the tube T.

Film advancing means, generally denoted as the numeral 22, comprise a pair of endless belts 24 extending around a pair of spaced pulleys 26. The pair of belts 24 are located diametrically to opposite sides of the mandrel 14 such that the tube T over the mandrel 14 is in contact with the flights of belts 24 facing the mandrel 14. Drive means, preferably a stepping motor 28, is operatively associated with one of the pulleys 26 of each belt 24 for incrementally driving or pulsing the pulleys 26 in the direction of the arrows in FIG. 1 to move the belts 24 and, thereby, incrementally advance a full package length of the film F.

A stepping motor is a motor that rotates in short and essentially uniform angular movements or pulses rather than fully continuous movement. The pulsing action is preferably in increments so short that film being fed is advanced with essentially continuous movement. The advantage is that through solid state controls, such as represented by the index controller in the present case, very precise feeding action can be gained while minimizing the cost of equipment. One suitable motor among several that can be successfully utilized is sold under the trademark Sigmax 802 by Sigma Instruments, Inc., Braintree, Massachusetts 02184.

Figure 2:
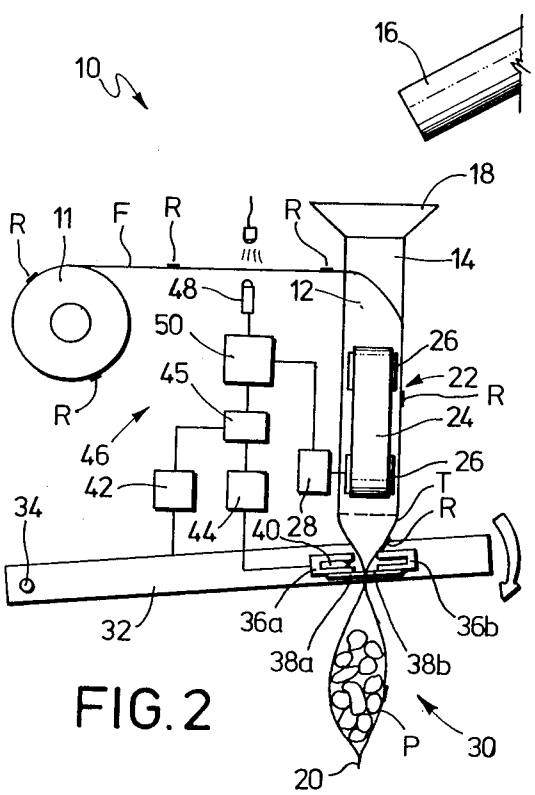
FIG. 2 is a schematic side view of the form, fill and seal package machine of the present invention with the drive belts not moving and stripping and sealing apparatus in an initial raised position and starting its downward movement toward the finished stripping and sealing position.
Figure 4:
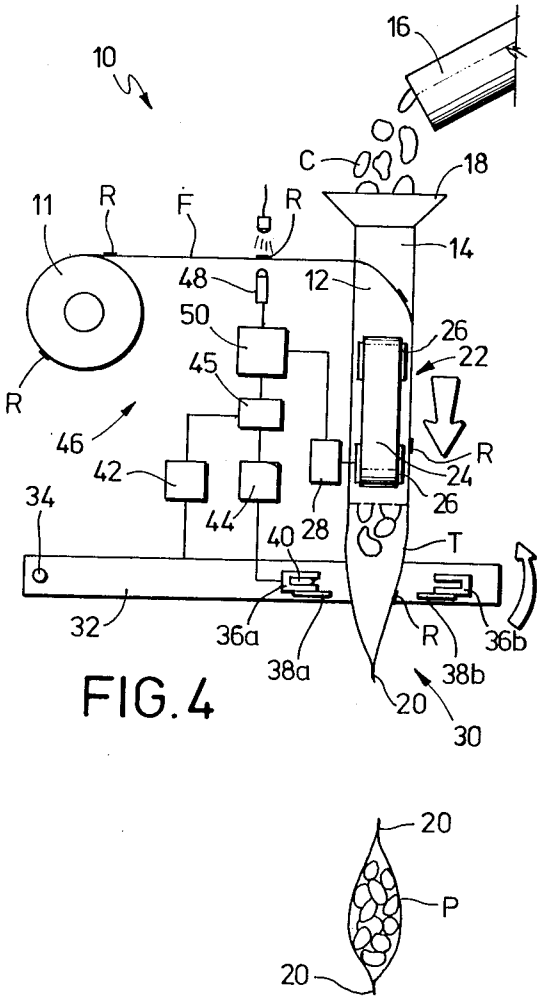
FIG. 4 is a schematic side view of the form, fill and seal package machine with the belts driven by stepping motors and feeding to form a new package and the stripping and sealing apparatus moving back to the initial raised position.
Figure 3:
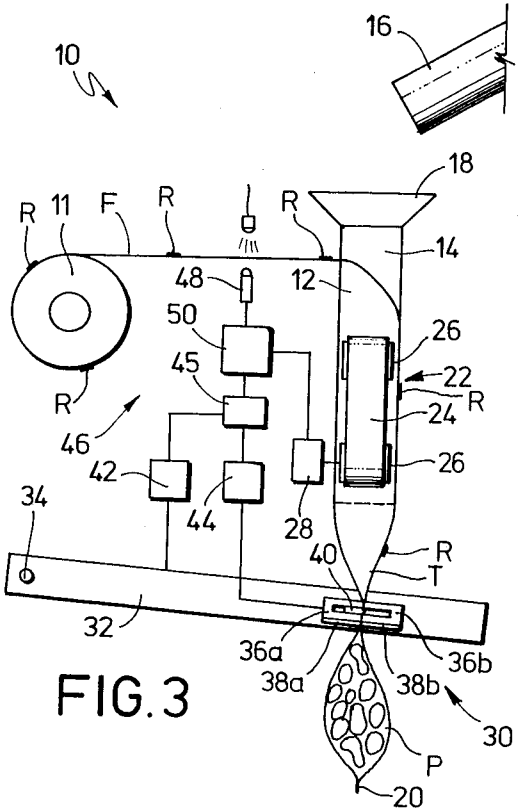
FIG. 3 is a schematic side view of the form, fill and seal package machine with the stripping and sealing apparatus in the lowered sealing and cutting position to complete a package.

With reference to FIGS. 2 through 4, the packaging apparatus 10 further includes a stripping and sealing apparatus, generally denoted as the numeral 30. The stripping and sealing apparatus 30 includes a pivoted carriage 32 extending generally horizontally as a cantilever from a pivot 34. The carriage 32 is movable back and forth in a generally vertical plane about the pivot 34, as indicated by the direction arrows in FIGS. 2 and 4.

A pair of facing, spaced apart tube sealing jaws **36*a* and 36*b* are mounted in the carriage 32 for reciprocal movement toward and away from each other. A pair of stripping jaws 38*a* and 38*b* are mounted on the sealing jaws 36*a* and 36*b***, respectively, for movement there-with. As shown, each of the stripping jaws 38*a* and 38*b* extend from the sealing jaw 36*a* and 36*b* to which it is attached into the space between the sealing jaws 36*a* and 36*b* toward each other. A package cut-off knife 40 is positioned in an appropriate pocket of one of the sealing jaws 36*a*, 36*b* and extends into the space between the sealing jaws to cut and separate the package P (see FIGS. 3 and 4). The tube T having a sealed bottom edge 20 extends downwardly through the space between the sealing jaws 36*a* and 36*b* in preparation to completing the formation of the package P.

The stripping and sealing apparatus 30 further includes drive means 42 operatively associated with the pivoted carriage 32 for selectively causing the carriage 32 to move about the pivot 34 between the raised position of FIG. 2 and the lowered position of FIG. 4. The drive means 42 can be of virtually any type, for example, a mechanical linkage or a pneumatic cylinder device. In addition, the stripping and sealing apparatus 30 includes actuator means 44 operatively associated with the sealing jaws 36*a* and 36*b*for selectively causing the sealing jaws 36*a* and 36*b* to move toward and away from each other between the full open position of FIG. 3 and the full closed position of FIG. 4. The actuator means 44 also operates the cut-off knife 40 and can be of any type, for example, pneumatic cylinder associated with each sealing jaw 36*a* and 36*b*.

Following the complete filling of the partially completed package P, as depicted in FIG. 2, the stripping and sealing apparatus 30 is actuated. First, actuator means 44 is activated to move the sealing jaws 36*a* and 36*b* toward each other until the stripping jaws 38*a* and 38*b* contact the film tube. Drive means 42 is then activated to move the carriage 32 downwardly about the pivot 34 from the raised position of FIG. 2 resulting in a downward stripping action to remove any product C from the sealing zone clearing the way for a clean, tight seal to be formed at the top of the package P. Concurrently, the actuator means 44 continues to move the sealing jaws 36*a* and 36*b* toward each other to the full closed position of FIG. 4 engaging the stripped zone of the tube T above the previously made seal 20 therebetween forming another transverse seal 20 to close the top end of the package P and thereby also to close and seal the bottom end of the tube T. Upon sealing of the package P, the cut-off knives 40 are actuated by actuator means 44 to sever the completed package P from the tube T midway of the transverse seal 20.

Preferably, the drive means 42 is controlled by a master controller 45, which may include an adjustable master cam driven by an adjustable speed motor (not shown). The drive means 42 preferably includes adjustable linkage, such as shown and claimed in prior U.S. Pat. No. 4,483,126, entitled Adjustable Drive Mechanism, issued Nov. 20, 1984, owned by the present assignee. This mechanism allows the length of the package to be controlled while maintaining the same home position at the top of the sealing jaw stroke.

Also in accordance with the preferred embodiment of this invention, the actuator means 44 is closely controlled to optimize the speed of the packaging cycle. The jaws 36*a*, 36*b* are opened and closed at the precise point in the cycle and moved the precise amount to obtain maximum output. To accomplish this result, the actuator means 44 may include opposed pneumatic control cylinders, control circuit and control linkage as set forth and claimed in copending application, Ser. No. 036,079, entitled Sealing Jaw Actuator, filed April 9, 1987.

Film length control means, generally denoted as the numeral 46, is also responsive to the master controller 45 and forms an important aspect of the present invention. This is for positioning the tube T so that the location of the transverse seals 20 are accurately located. The result is accomplished by controlling the length of the bag tube T pulled into position at the sealing jaws 36*a*, 36*b* by the belts 24. Toward this objective, as can be seen in FIGS. 2 through 5, the film F includes registration marks R imprinted thereon at spaced apart longitudinal positions corresponding to the full length of film required for a package P to be formed. As can be best seen in FIG. 5, the registration marks are located at an intermediate point of the full length L of the film to be fed. The film advance means 46 includes photocell means 48 for detecting the registration marks R as the film F is advanced toward the tube former 12. As shown FIGS. 2–4, the photocell means 48 is located upstream of the tube former 12 relative to the direction of movement of film F.

An index controller 50 is operatively connected to the photocell means 48 and to the stepping motors 28 driving the belt pulleys 26. The index controller 50 operates the stepping motors 28 so that the belts 24 are constantly accelerated from standstill to a maximum velocity and then immediately and constantly decelerated back to standstill (see FIG. 6). This driving occurs over a predetermined period of time to advance or feed a full length L of film F required for a package P.

The index controller 50 is also operatively connected to tne master controller 45 so as to be synchronized with the carriage drive means 42 and the jaw actuator means 44. The index controller 50 controls the operation of the stepping motors 28 as a function or the position of the registration mark R on the film F. Tne index controller 50 is preset or pre-programmed to activate and deactivate the stepping motors 28 of the belts 24 when a predetermined number of steps or pulses of the stepping motors 28 have been counted after a registration mark R has been sensed passing the photoelectric cell 48. The index controller 50 can be pre-programmed with a plurality of different sets of such predetermined numbers of steps or pulses corresponding to different package P lengths to be made by the packaging machine. This greatly reduces the set-up from manufacturing one size package P to another size package P.

More specifically, the belts 24 are operated by the stepping motors 28 to incrementally or pulse feed the full length L of the film F through the apparatus 10. The photoelectric cell 48 senses a passing registration mark R, and the index controller 50 then counts the number of steps or pulses of the stepping motors 28 until the predetermined number of pulses corresponding to the location of the transverse seal 20 for a package P of a desired length has been counted. The index controller 50 then deactuates the stepping motors 28. Next, the carriage drive means 42 and sealing jaw actuator means 44 are actuated by the master controller 45 to form the transverse seal 20 at the proper location of the film tube T to form the package P.

Figure 6:
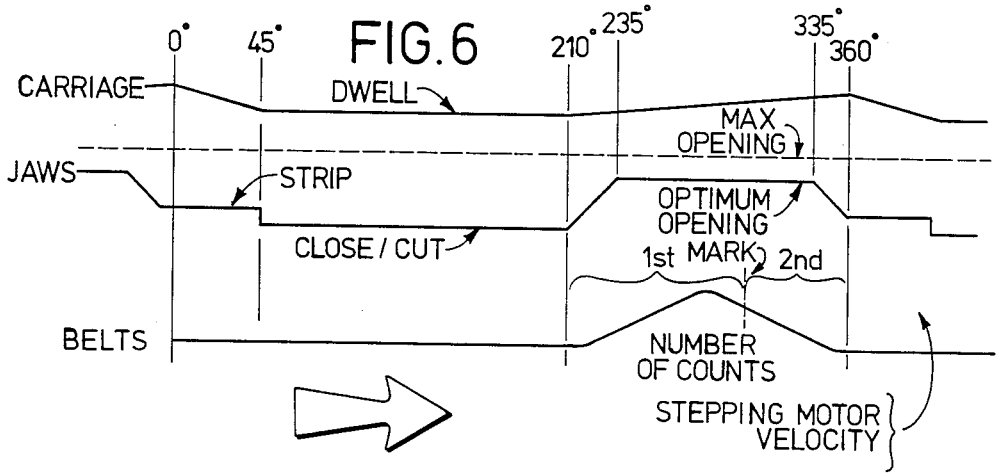

FIG. 6 graphically represents the movement and timing of the belts 24, carriage 32 and sealing jaws 36*a* and 36*b* during a package forming cycle in terms of angular degrees of the timing cam of the master controller 50. At the start of the represented cycle, depicted at 0° on the graph, the carriage 32 is stationary, the belts 24 have decelerated to a standstill, and the sealing jaws 36a and 36b have been moved toward each other to the extent that the stripping jaws 38a and 38b are in contact with the film tube T, as can be seen in FIG. 2. Through the first 45° of the package forming cycle, the belts 24 remain at a standstill, the sealing jaws 36a and 36b remain stationary with the stripping jaws 38a and 38b in contact with the film tube T, and the carriage 32 is pivoted downwardly from its raised position shown in FIG. 2 to its lowered position shown in FIG. 3. This action causes stripping of product C from the zone or area of the film tube T to be sealed together.

From 45° of the cycle to 210° of the cycle, the belts 24 remain at a standstill, the carriage 32 dwells, or stays stationary at the lowered position. The sealing jaws 36a, 36b close together forming the transverse seal 20 and the knife 40 cuts through the tube T at the seal to sever the finished package P, as can be seen in FIG. 4.

From 210° of the cycle to about 235° of the cycle, the carriage 32 is still at dwell at the lower position, and the sealing jaws 36a and 36b are retracted to their full open position. From 235° of the cycle to 360° of the cycle, the carriage 32 moves from its lowered position (FIG. 3), through the intermediate position (FIG. 4) and back to its raised position (FIG. 2). From about 235° to about 335° of the cycle, the sealing jaws 36a and 36b remain in their full open position, and from about 335° to 360° of the cycle the sealing jaws 36a and 36b are moved back toward each other until at 360° the stripping jaws are in contact with the succeeding length of tube T to be next formed into a package P.

From about 210° to about 315° of the cycle the belts 24 are accelerated at a substantially constant acceleration from standstill to a maximum predetermined velocity, and from about 315° to about 360° of the cycle the belts 24 are decelerated at a substantially constant deceleration back to standstill feeding another full length L of film F to be formed, filled and sealed into a package P.

Initially, the number of steps of the stepping motor 28 required to move the length of film F between registration marks R and corresponding to the full length L of film F for a package P is determined. This number is stored in the index controller 50 for each size package. The controller 50 is programmed to constantly accelerate and decelerate the stepping motors 28 and, therefore, the belts over the distance to feed a full length L of film. The controller 50 is also programmed to deactivate the stepping motors 28 substantially at a point corresponding to the 360° location of the timing cam of the master controller 45.

With the stepping motors 28 in operation, the belts 24 incrementally feed a full length L of film F from the supply roll 11 over the mandrel 14 forming a film tube T. As the film F is fed, the total number of feed increments up to the point of the passing of a registration mark R is sensed, and this is recorded by the index controller 50. The controller 50 then counts the predetermined number of motor steps after the sensing of the registration mark R during continued incremental feeding of the film F. When the location of the tube T identified by reaching the predetermined number of feed steps of the motor 28 is reached, the motor has decelerated to zero and the controller 50 deactivates the motor immediately stopping the belts 28, thus, terminating the feed of the film F. As the belts 28 stop, the master controller 45 activates the carriage drive means 42 and sealing jaw actuator means 44 to strip and seal the package P. After the carriage drive means 42 and sealing jaw actuator means 44 have cycled forming and cutting a package P, the packaging machine recycles under the control of the master controller 50 and at the 210° position of the timing cam, the stepping motors 28 are reactivated to feed another full length L of film for the next package P.

As the belts 28 resume movement feeding this next full length L of film F past the photoelectric cell 48, the controller 50 senses and totals the elapsed number of motor steps before a registration mark R passes the photoelectric cell 48, and the predetermined number of motor steps after a registration mark R passes the photoelectric cell 48. The controller 50 compares this totalled number of motor steps to the programmed or specified number of motor steps and the number of the previous cycle. If the totalled number of motor steps is different than the programmed number of motor steps corresponding to the full length L of film F for a package P, the index controller 50 corrects the number of motor pulses for the next cycle. The revised or corrected totalled number of motor steps before and after the passing of a registration mark R past the photoelectric cell 48 then matches the actual number of motor steps between registration marks R.

For example, if the total number of steps of the motor (those steps counted before plus the predetermined number of steps after a registration mark R passes the photoelectric cell) exceeds the preprogrammed number of motor steps, the film F is stretched. With this occurrence, the index controller 50 corrects the number of stepping motor feed increments, and consequently the spacing, by increasing the acceleration and deceleration. This results in an increased average velocity of the film. Conversely, if the film shrinks, the index controller 50 decreases the acceleration and deceleration effectively reducing the spacing between the packages.

In summary, the form, fill and seal packaging machine of the present invention employs significant advances over the prior art. By the use of a stepping motor 28 to incrementally drive the feed belt 24 on an intermittent basis, improved control with less expensive machine components is obtained. Most significantly, expensive driving transmissions, clutches and brakes are eliminated. Furthermore, with the precise control provided by the index controller 50 of the stepping motor 28, the belt 24 can be made to substantially constantly accelerate over the first half of the driving time and substantially constantly decelerate over the remaining half. This control prevents slippage between the belt 24 and the film F since sudden acceleration/deceleration is eliminated. Along with the reduction of slippage, goes significant less belt wear and the ability to use a wider range of packaging films. With regard to the film, it has been found that film having a slicker outer surface, which is preferred by customers for some product, can now effectively be used without sacrificing speed of the packaging machine.

The index controller 50 can be easily pre-programmed to operate on a variety of package sizes. To operate on a slightly larger bag, the average speed of the stepping motors 28 can be simply increased; and conversely, for a slightly smaller bag the average speed can be decreased. Advantageously, this concept can be utilized to provide the appropriate change in the cycle to accomodate for stretched or shrunken film that might occur during the normal operation of the packaging system. In order to provide for the desired increase/decrease in velocity, the acceleration/deceleration remains equally divided over the full driving cycle and is simply slightly increased or decreased, as necessary.

Preferably, during the feed of the film F, the index controller 50 is programmed to complete the deceleration to a velocity of 0 at exactly the same time as the carriage 32, which is controlled by the master controller 45, is ready to move downwardly to provide the stripping operation. Of course, the master controller 45 is provided with an interconnection to the index controller 50 in order to assure that the movements are synchronized.

In this disclosure, there is shown and described only the preferred embodiment of the invention, but as aforementioned, it is to be understood that the invention is capable of use in various other combinations and environments and is capable of changes or modifications within the scope of the inventive concept as expressed herein.

I claim:

1. The method of making form, fill and seal packages of constant length during a fixed time packaging cycle comprising the steps of:

feeding by a specified number of increments a full length of film having a registration mark at an intermediate point in order to produce a package of desired length;

sensing said registration mark during feeding;

counting a predetermined number of feed increments past said registration mark during continued feeding; and sealing said package at a sealing location upon reaching said predetermined number of feed increments, whereby said package is assured of being full length.

2. The method of claim 1, wherein is provided the additional step of:

terminating the feed of said film upon reaching said predetermined number prior to sealing said package.

3. The method of claim 1, wherein is provided the additional step of:

sensing the number of feed increments before and after reaching said mark; and correcting the predetermined number of feed increments to cause said increments of the film feeding to match the increments between the registration marks.

4. The method of claim 1, wherein the step of feeding the full length of film comprises constantly accelerating the film from a standstill to a maximum velocity and constantly decelerating the film from the maximum velocity to standstill.

5. A form, fill and seal package machine for forming packaging film, including a registration mark at an intermediate point of each package length of film, into a package of predetermined length, comprising:

a mandrel about which a packaging film is to be formed;

former means for forming the packaging film around said mandrel;

film feed means for intermettently feeding, by a specified number of increments, a full length of packaging film corresponding to a desired package length;

means for sensing a registration mark on the packaging film during feeding by said feed means;

means for counting a predetermined number of feed increments of said film feed means past the registration mark during continued feeding by said feed means; and, sealing means for sealing the package at a sealing location corresponding to said counting means reaching said predetermined number of feed increments of said film feed means.

6. The form, fill and seal package machine of claim 5, wherein said film feed means comprises: at least one endless belt in contact with the packaging film around said mandrel; and, belt drive means including a stepping motor for moving said belt in increments.

7. The form, fill and seal package machine of claim 5, wherein said film feed means comprises:

at least one endless belt in contact with the packaging film around said mandrel; and, belt drive means for accelerating said belt device from a standstill to a maximum velocity and constantly decelerating said belt device from the maximum velocity back to standstill during the feeding of each full length of film.

8. The form, fill and seal package machine of claim 5, wherein:

said counting means counts the total number of feed increments of said film between said marks; and, means for correcting the predetermined number of feed increments counted by said counting means to cause the feed increments of said film feed means to match the feed increments between said registration marks on said packaging film.

9. The emthod of claim 3, including the additional step of comparing an actual number of feed increments before and after sensing a registration mark during one packaging cycle to the specified number of feed increments for a package of desired length and to the same number of the previous packaging cycle in order to fully compensate for film shrinkage, film stretching and belt slippage.

* * * * *